United States Patent [19]

Byrne

[11] 3,943,904

[45] Mar. 16, 1976

[54] SINGLE INJECTOR THROTTLE BODY

[75] Inventor: James C. Byrne, Greentown, Ind.

[73] Assignee: General Motors Corporation, Detroit, Mich.

[22] Filed: July 19, 1974

[21] Appl. No.: 490,223

[52] U.S. Cl...... 123/139 AW; 123/28; 123/32 AE; 123/119 R

[51] Int. Cl.[2] ..... F02M 32/00

[58] Field of Search..... 123/139 AW, 139 BF, 28, 123/29, 8.09, 32 AE

[56] References Cited

UNITED STATES PATENTS

| | | | |
|---|---|---|---|
| 3,252,539 | 5/1966 | Ott et al. | 123/119 R |
| 3,635,201 | 1/1972 | High | 123/119 R |
| 3,648,987 | 3/1972 | Arikawa | 123/119 R |
| 3,656,464 | 4/1972 | Hilborn | 123/139 BF |
| 3,782,639 | 1/1974 | Batz et al. | 123/139 AW |
| 3,788,287 | 1/1974 | Falen et al. | 123/139 AW |

*Primary Examiner*—Charles J. Myhre
*Assistant Examiner*—Paul Devinsky
*Attorney, Agent, or Firm*—J. C. Evans

[57] ABSTRACT

A throttle body for a rotary engine includes an electronically controlled single fuel injector with discharge pintle that is located above and between two counter-rotating throttle valves with the fuel supply, rotor lubricating oil and idle air being directed through an orifice located below the injector. An atmospheric passage is interposed between the injector and the fuel supply orifice to serve as a vacuum break, through which a conical spray pattern is directed into the orifice which has walls contoured to receive the conical spray pattern and direct it in an unrestricted fashion as a spray cone into the intake manifold of a vehicle during low intake manifold vacuum conditions. The air passage serves to direct idle air through the orifice when throttle valves are closed to produce sonic mixing of idle air and fuel during operation of the engines at a high intake manifold vacuum.

5 Claims, 6 Drawing Figures

SINGLE INJECTOR THROTTLE BODY

This invention relates to fuel supply systems for internal combustion engines and more particularly to a throttle body including a fuel injector in association therewith for supply of fuel to an intake manifold of an internal combustion engine.

Electronic fuel injection systems have been proposed for use in internal combustion engines to affect a close control of fuel supply into the intake manifold during engine operation.

Sonic injection systems of the type disclosed in U.S. Pat. No. 3,785,354, issued Jan. 15, 1974 to John W. Moulds includes an injector with the fuel injector nozzle at atmospheric pressure and with fuel admitted through a gallery through which part of the idle air to the engine is drawn and across which engine vacuum differential exists. When engine vacuum exceeds thirteen inches of mercury, the gallery air flow and injected fuel is directed through a sonic orifice to improve mixing of the idle air and the injector fuel prior to passage into the induction passage. The injector nozzle in such cases is maintained at atmospheric pressure and a fuel rail pressure regulator is not required. When such systems operate under low engine vacuum conditions, such as occurs during engine starting and under hard acceleration, the gallery air flow is non-sonic and the fuel spray pattern from the orifice passes as a hose stream into the induction passage with consequent reduction of mixing of the air-fuel charge prior to passage into the induction passage.

In other fuel injection systems, a non-sonic form of fuel injection is produced by mounting the injector nozzle into the intake manifold with the nozzle sensing engine vacuum. Examples of such systems are disclosed in U.S. Pat. Nos. 3,635,201 and 3,786,789, issued Jan. 18, 1972 and Jan. 22, 1974 to Carl F. High and Paul N. Barr et al., respectively. In such arrangements, a pressure regulator is required to compensate for variations in fuel flow rate that occur in accordance with changes in engine vacuum. In such cases, a spray cone is produced at the nozzle outlet which produces improved mixing as compared to sonic injector arrangement under engine starting and hard acceleration conditions. However, the spray cone pattern does not produce as good an air-fuel mixture as a sonic injection system during engine operation at high intake manifold vacuum.

Accordingly, an object of the present invention is to provide an improved air-fuel induction system for an internal combustion engine, especially suited for use in rotary engine applications including a single electronically controlled fuel injector with a non-sonic spray pattern in the form of a diverging spray cone from a pintle in the injector outlet directed through an orifice configured to pass the full spray cone pattern into the intake manifold of the vehicle under low vacuum conditions in the intake manifold as produced during engine starting and hard acceleration operations and wherein means are provided to direct idle air through the orifice along with lubricant for the rotary engine parts so as to produce sonic mixing of the oil-air-fuel mixture under engine idle conditions for improved burning of the air-fuel mixture and for reducing metered oil flow into the rotary engine so as to improve engine life and durability.

Still another object of the present invention is to provide an improved air-fuel supply system for an internal combustion engine including an electronically controlled fuel injector having a pintle to produce a conical spray pattern and means for directing the conical spray pattern into the intake manifold of the vehicle under intake manifold conditions less than thirteen inches of mercury and wherein an orifice is in alignment with the spray cone pattern and configured to direct it without interference into the intake manifold under the aforesaid conditions and wherein further means are included to direct idle air through the orifice under idle conditions so as to produce sonic mixing of the spray cone pattern under engine idle and high engine vacuum conditions thereby to produce optimized air-fuel mixing during normal vehicle operation.

Still another object of the present invention is to provide an improved air-fuel carburetion assembly for use in internal combustion engines including a throttle body having an air-fuel passage therethrough open at opposite ends with one end adapted to be connected to the intake manifold of a vehicle engine and the opposite end thereof being covered by a throttle plate having a bore therethrough for passage of air into the engine under the control of a throttle valve; a fuel flow orifice through the throttle plate includes a small diameter inlet throat and a radially outwardly diverging outlet portion through which fuel is directed from an electronically controlled fuel injector having a nozzle with an outlet under the control of a movable pintle to produce a conical spray pattern of a shape which passes through the orifice without restriction so as to direct a spray cone pattern of fuel into the intake manifold of the vehicle under normal vehicle operations; and wherein air passage means are included in the throttle plate to isolate the spray nozzle from vacuum conditions within the engine and to direct idle air from the throttle plate bore through the orifice to produce sonic mixing of the spray cone pattern and idle air under high vacuum intake manifold conditions with the throttle plates closed.

Further objects and advantages of the present invention will be apparent from the following description, reference being had to the accompanying drawings wherein a preferred embodiment of the present invention is clearly shown.

Figure 1:
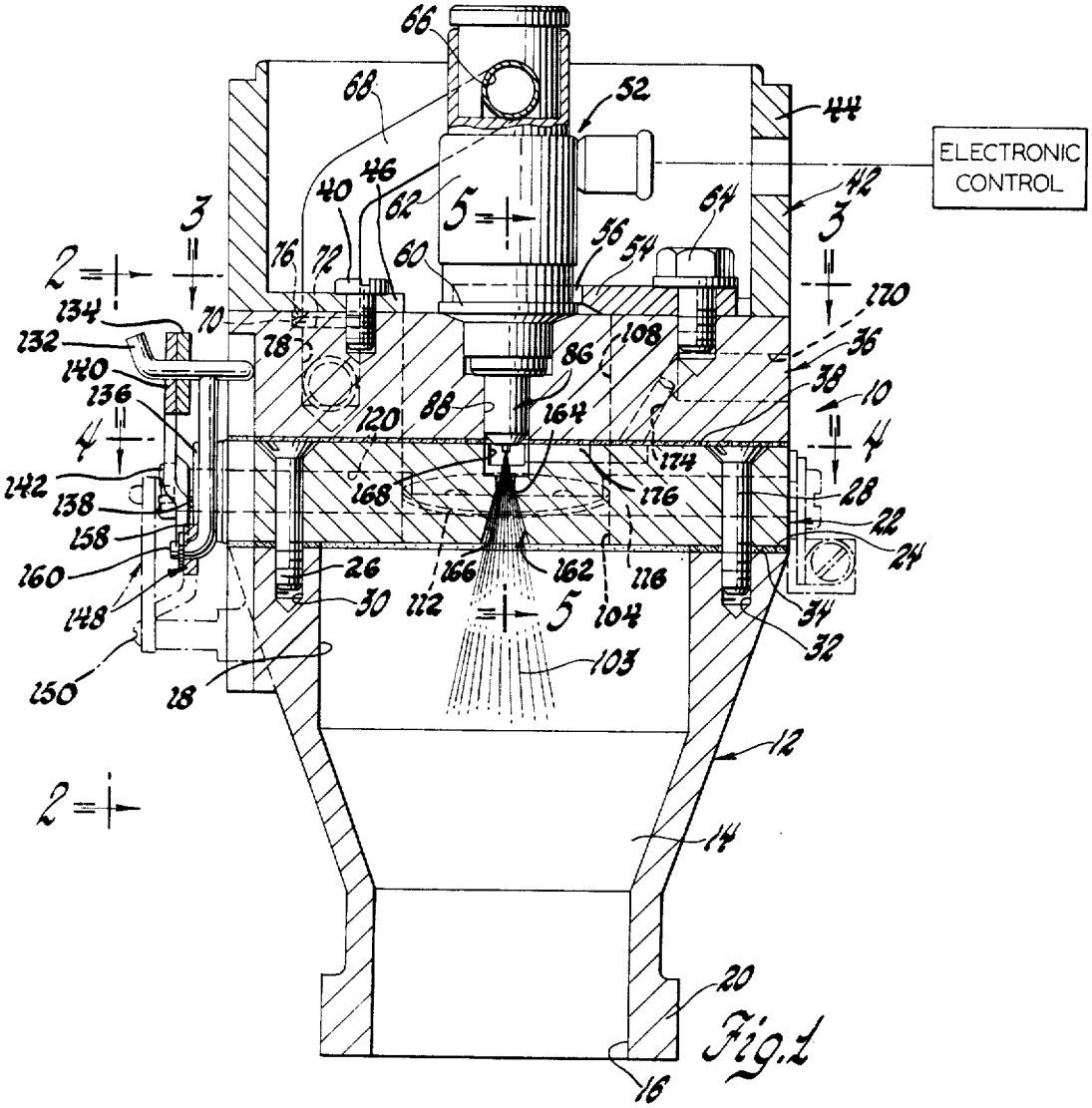
FIG. 1 is a view in vertical section of a throttle body and fuel injector arranged in accordance with the present invention.

Referring now to FIG. 1, a single injector throttle body or housing assembly 10 is illustrated including a throttle body 12 having a convergent air-fuel flow passageway 14 therethrough with opposite open ends at 16 and 18. The throttle body 12 includes a flange 20 at the end opening 16 for connection to the intake manifold of an internal combustion engine, which, may be in the form of the intake manifold of a rotary engine of the type shown in U.S. Pat. No. 3,788,782, issued Jan. 29, 1974 to Robert E. Morgan. The working components of such engines require a thorough mixing of air-fuel components in the fuel supply thereto as well as mixing of lubricant for the rotary components therein all of which is produced by means of the assembly 10.

Figure 3:
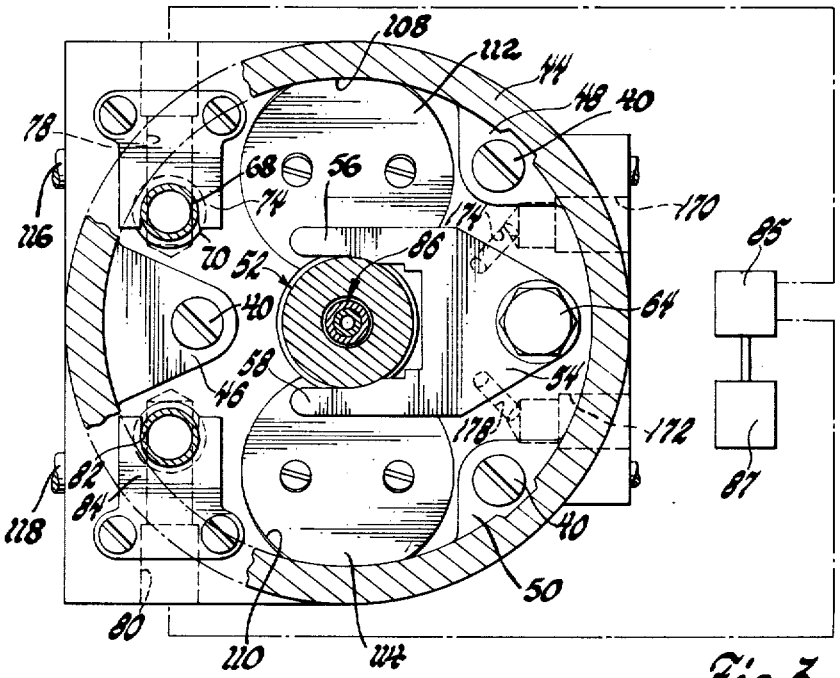
FIG. 3 is a horizontal cross sectional view taken along the line 3—3 of FIG. 1, looking in the direction of the arrows.
Figure 4:
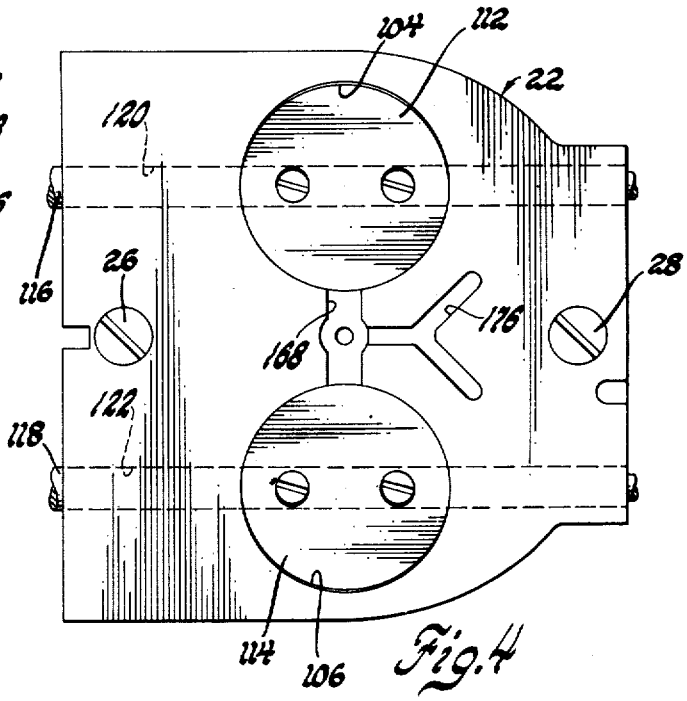
FIG. 4 is a horizontal cross sectional view taken along the line 4—4 of FIG. 1, looking in the direction of the arrows.
Figure 6:
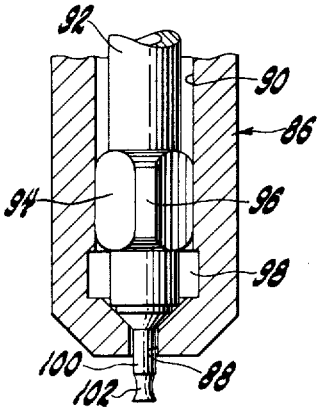
FIG. 6 is an enlarged fragmentary sectional view of a tip portion of the fuel injection nozzle in the assembly of FIG. 1.

The housing assembly 10 further includes a throttle plate 22 which is secured to the upper end surface 24 of the body 12 by suitable fastening means illustrated as screws 26, 28 which are threadably received within tapped holes 30, 32 in the upper end surface 24 of the body 10 as best seen in FIG. 1. The interface between the upper surface 24 of the throttle body 12 and the throttle plate 22 is sealed by means of a gasket 34. A support plate 36 of housing assembly 10 is secured to the upper surface 38 of the throttle plate 22 by suitable fastening means such as a plurality of spaced screws 40, the shanks of which are illustrated in FIG. 4. The support plate 36 receives an air cleaner base 42 that is best illustrated in FIG. 3 as including an outer peripheral flange 44 and a plurality of radially inwardly directed lugs 46, 48, 50 each of which are secured by means of the screws 40 with respect to the support plate 36.

A non-sonic electronically controlled fuel injector 52 is fastened to the upper surface of the support plate 36 by means of a retainer plate 54 having a pair of bifurcated arms 56, 58 located in overlying relationship with a shoulder 60 on a tubular outer housing 62 of the non-sonic fuel injector 52. The retainer plate 54 is secured to the upper surface of the support plate 36 by means of a screw element 64 for fixedly securing the injector in place on top of the assembly 10.

More particularly, the non-sonic fuel injector 52 is of a type more specifically set forth in U.S. Pat. No. 3,684,318, issued Aug. 15, 1972 to Clarence J. Eckert et al. It includes a pair of fuel supply ports 66, one of which is illustrated in FIG. 1 connected to a fuel supply tube 68 having a rolled flange 70 thereon seated against an undercut shoulder 72 in the upper surface of the support plate 36 and sealed with respect to the underside of a tube retainer 74 by means of an annular gasket 76 seated in the undercut shoulder 72. The tube retainer 74 includes a pair of spaced apart bifurcated portions that hold the tube 68 within the support plate 36 for communication with a lateral bore 78 in the support plate 36 which is adapted to be connected to a pressurized fuel supply such as described in U.S. Pat. No. 3,684,318. As seen in FIG. 3, the fuel supply further includes a lateral port 80 on the opposite side of the plate 36 which is in communication with an open end of a second fuel supply tube 82 secured to the plate 36 and sealed with respect thereto by the same means as discussed with respect to the tube 68 and by means of a tube retainer 84 having the same configuration as retainer 74 for tube 68. The fuel supply is diagrammatically shown in FIG. 3 as including a fuel pump 85 that supplies fuel from a tank 87.

Fuel supply to the injector 52 is directed through a nozzle 86 supportingly received within a bore 88 located centrally of the plate 36. The nozzle 86 includes an outlet opening 88 therefrom in communication with a fuel supply bore 90 in which is located a plunger 92 reciprocated with respect to the bore 90 by electromagnetic means (not shown) within the non-sonic flow nozzle 52. The plunger 92 includes a fluted guide portion 94 thereon having circumferentially spaced guide ribs 96 is sliding relationship with the inner wall of the bore 90 for flow of fuel to an outlet chamber 98 in communication with the outlet opening 88. An injector pintle 100 is located within the outlet opening 88 and includes a radially outwardly flared tip 102 thereon which serves to produce a non-sonic spray cone 103. The non-sonic injector is characterized by being operative independently of the intake manifold vacuum and does not require a pressure regulator to control the rate of fuel flow through the injector 52 in accordance with changes in the intake manifold vacuum.

In accordance with certain principles of the present invention, the throttle plate 22 includes a pair of throttle bores 104, 106 on either side thereof each in communication with the air-fuel passage 14 in the throttle body 12. Air flow to the bores 104, 106 is through bores 108, 110 formed in the support plate 36 in overlying relationship to the bores 104, 106 to receive air flow from an air cleaner connected to the base 42. The aligned bores 104, 108 and 106, 110 serve to direct mass flow of air into the throttle body 12 during engine operation. It is under the control of a pair of counterrotating throttle valves 112, 114 located respectively in the bores 104, 106. Valves 112, 114 are secured to shafts 116, 118 respectively directed through shaft bores 120, 122 in the throttle plate 22. The shaft 118 has an outboard end 124 thereon secured by means of a screw 126 to one end of a throttle lever 128 having a slot 130 formed in the distal end thereof which is secured over an upper bent end 132 of a throttle link 134. A return spring 136 is wound around the outboard end 124 with one end thereof biased against plate 36 and the opposite end thereof biased against the lever 128 to spring bias the throttle valve 114 into a closed position as shown in FIG. 5.

The shaft 116 includes an outboard end 138 secured to a second lever 140 by means of a screw 142. The lever 140 is bent outwardly at 144 to overlie the lever 128. It further includes a slot 146 in the end thereof which is also fit over the bent end 132. A return spring 136 is secured between the lever 140 and the plate 36 for biasing valve 112 into a closed position as shown in FIG. 5.

Figure 2:
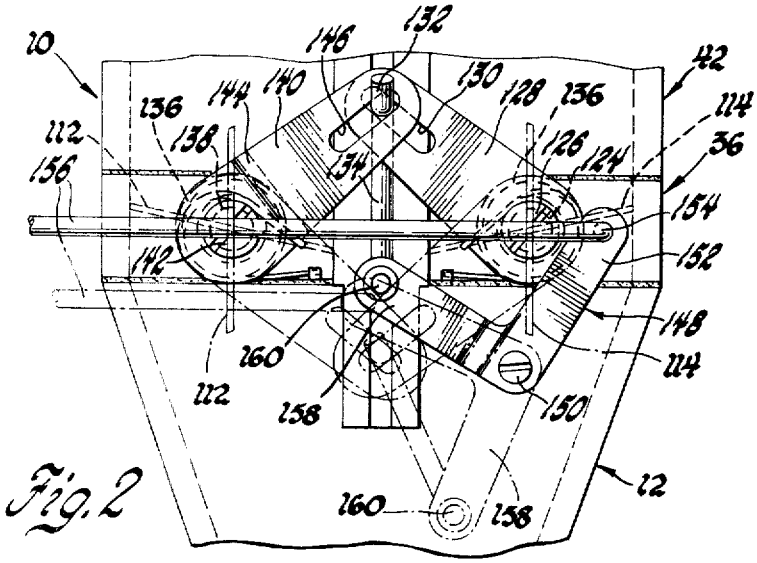
FIG. 2 is a fragmentary side elevational view taken along the line 2—2 of FIG. 1, looking in the direction of the arrows.

A bellcrank throttle actuator 148 is pivotally secured at 150 to the throttle body 12. One arm 152 thereof is connected to the end 154 of a throttle link 156 adapted to be connected by suitable means (not shown) to the accelerator pedal of a vehicle. A second leg 158 of the bellcrank 148 is secured to a lower end 160 of the throttle link 134 whereby movement of the throttle link 156 to the left as viewed in FIG. 2 will cause the throttle link 134 to be pulled downwardly thereby to shift the levers 128, 140 into the dotted line position as shown in FIG. 2 to produce counterrotation of each of the throttle valves 112, 114 to a vertically aligned wide open throttle position as shown in FIG. 2 wherein there is unrestricted communication through the throttle bores 104, 106 into the air-fuel passage 14.

Figure 5:
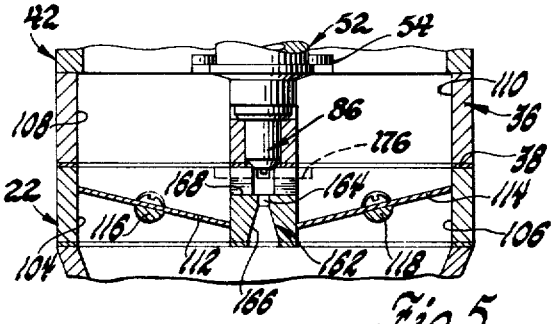
FIG. 5 is a vertical sectional view taken along the line 5—5 of FIG. 1, looking in the direction of the arrows.

In accordance with certain principles of the present invention, the throttle plate 22 includes a fuel supply orifice 162 located equidistantly between each of the bores 104, 106 as best seen in FIG. 5. The orifice 162 includes a small diameter inlet throat 164 and a radially outwardly diverging outlet portion 166 thereon in communication with the passage 14. A transverse passage 168 is formed in the upper surface of the throttle plate 22 so as to intercommunicate each of the bores 104,

106 with the inlet throat 164 at a point above the valves 112, 114, as seen in FIG. 5. The inlet throat 164 is aligned colinearly of the outlet opening 88 in the nozzle 86 and in spaced relationship thereto across the transverse passage 168. Passage 168 is maintained in communication with atmospheric pressure and thus serves as a vacuum break between the intake manifold vacuum as manifested in the air-fuel passage 14 thereby to isolate the nozzle 86 from operational changes in intake manifold vacuum.

The support plate 36 includes a pair of threaded bores 170, 172 on one side thereof, each of which are adapted to be connected to a metered source of lubricant for flow through the assembly 10 to lubricate rotating parts of a rotary engine. Details of the metered lubricant system are set forth in the above-mentioned U.S. Pat. No. 3,788,782.

The bore 170 is in communication with an upwardly inclined passage 174 in plate 22 that communicates with a depression 176 in the upper surface of the throttle plate 22. Likewise, the bore 172 is in communication with an upwardly inclined passage 178 in plate 22 likewise in communication with the depression 176. The depression 176 communicates with the transverse passageway 168 at the inlet throat 164 whereby lubricant will flow through the orifice 162 to be thoroughly mixed with the fuel and air charge as they pass through the passage 14 into the intake manifold of a vehicle. The admission of the metered engine lubricating oil through the orifice 162 produces improved oil, air and fuel mixing so that the metered oil flow rate can be reduced while improving engine life and durability.

In one working embodiment, the electronically controlled nozzle 86 has an outlet opening 88 of 0.063 inches diameter. The air passage 168 between the nozzle opening 88 and the inlet throat 164 has a depth of 0.218 inches. The conical spray pattern from the nozzle 86 has an included angle of approximately 20°. The orifice throat 164 has a depth of 0.080 inches and a diameter of 0.100 inches. The diverging portion 166 has a maximum outlet diameter of 0.310 inches with a truncated cone shape including an angle of 30°. This configuration of the orifice 162 will assure that the non-sonic spray cone 103 will freely pass through the throttle plate into the passage 14 as a spray pattern to produce optimized mixture of air and fuel particles during the low intake vacuum mode of engine operation.

By virtue of the aforesaid arrangement, under engine operating conditions wherein a reduced vacuum is produced in the passage 14, for example, under engine starting and hard accelerations, the fuel supply to the passage 14 is in the form of a conical spray pattern 103 that, under reduced intake manifold vacuum conditions, represents an optimum mode for mixing air, fuel and lubricant prior to passage into the intake manifold of the vehicle.

Slight variance in engine intake manifold vacuum does not effect the distribution of fuel as a spray cone from the nozzle 86 because of the vacuum break action of the transverse passage 168. The integrity of the spray cone with its optimized mixing of air and fuel in the passage 14 is achieved by virtue of the careful contouring of the inlet throat 164 and outlet portion 166 of the orifice 162. The contour of orifice 162 enables the physical shape of the cone 104 to freely pass from the non-sonic injector nozzle 86 into the passage 14 during reduced intake manifold vacuum engine operating modes.

During engine idle operation and high engine intake manifold vacuum conditions, the assembly 10 affords a further advantage in that the passage 168 will communicate the orifice 162 with atmospheric pressure at the inlet throat 164. With the throttle valves 112, 114 closed, under idle conditions, high intake manifold vacuum will exist on the outlet portion 166. This will cause the idle air directed through the passage 168 and through the orifice 162 to be sonic thereby to produce an improved mixture of air with the spray cone 104 with resultant improved combustion of the air-fuel components within the engine so as to effect a reduction of emissions from the engine during this operating mode.

While the embodiments of the present invention, as herein disclosed, constitute a preferred form, it is to be understood that other forms might be adopted.

While

What is claimed is:

1. A fuel air induction system comprising a throttle body having opposite ends thereon including an inlet end in communication with atmosphere and an outlet end adapted to be connected to the intake manifold of a vehicle, said throttle body including a converging passage therein with a large diameter at the inlet end of said body and a reduced diameter at the outlet end of said body, a throttle plate secured on the inlet end of said body including a pair of throttle bores therethrough, a throttle valve located in each of said bores, means for producing counterrotation of said valves from a closed idle position to an open position within each of said throttle bores, said throttle plate including a fuel supply orifice therethrough located between each of said bores having an atmospheric inlet end and a diverging outlet in communication with said converging passage, said orifice serving as a vacuum break between engine intake manifold vacuum within said throttle body and atmosphere, passage means in said throttle plate in communication with each of said bores above said throttle valves operative to define an idle air path from atmosphere to said atmospheric inlet end of said orifice when said throttle valves are in their closed idle position, fuel injector means including a nozzle portion having an outlet and including an outwardly extending pintle movable with respect to said outlet port, means for directing fuel to said nozzle outlet and across said pintle to produce a conical spray pattern therefrom, means for supporting said nozzle portion in coaxially spaced relationship to said orifice to locate said pintle above the atmospheric inlet end to said orifice, said orifice in said throttle plate having its inner wall contoured to receive said conical spray pattern and direct it without interference as a non-sonic, atmospheric spray pattern into said throttle body under reduced intake manifold vacuum conditions, said orifice having idle air directed therethrough from said passage means under increased intake manifold vacuum conditions with said throttle valves in a closed position to produce a sonic idle air flow through said orifice for optimizing fuel-air mixing under idle operation.

2. A fuel air induction system comprising a housing having an air-fuel passage therethrough including an inlet in communication with atmosphere and an outlet in communication with the intake manifold of an internal combustion engine, means defining a throttle bore for communicating said inlet and outlet ends of said housing, a throttle valve in said bore movable with respect thereto between closed and opened positions, means for operating said throttle valve in response to accelerator operation, a fuel flow orifice in said housing having an atmospheric inlet end in communication with the inlet end of said housing and an outlet end in communication with the outlet of said housing, passage means for communicating the atmospheric inlet end of said orifice with atmospheric pressure, fuel injector means including a nozzle with an outlet aligned colinearly of said orifice in spaced relationship to the atmospheric inlet end thereof, means including a pintle movable with respect to said nozzle outlet to produce a conical spray pattern at atmospheric pressure directed through the inlet end of said orifice, said orifice serving as a vacuum break between the outlet end of said housing and said nozzle, said orifice having an inner wall contoured as a divergent cone to permit unrestricted passage of said conical spray pattern from the atmospheric end of said orifice to the outlet end thereof thereby to direct a cone spray fuel pattern into the intake manifold for mixing with air under reduced vacuum conditions in the intake manifold, said passage means serving to direct idle air through said orifice when said throttle valve is closed under high intake vacuum conditions to produce a sonic flow of idle air through said orifice for producing sonic mixing of said atmospheric cone spray pattern and idle air during high intake vacuum engine operations.

3. A carburetor for an internal combustion engine having an intake manifold with a reduced vacuum mode and a high vacuum mode therein during vehicle operation comprising: a throttle body having an air-fuel passage therethrough with opposite open ends, one of said ends adapted to be connected to the intake manifold of an engine, a throttle plate on the opposite open end of said throttle body including a throttle bore therethrough, a throttle valve located in said bore, means for rotatably supporting said valve within said bore for movement between closed and open positions, means forming a fuel flow orifice in said plate having an inlet throat section thereon and an outwardly diverging outlet portion thereon in communication with the inlet end of said throttle body, a support plate connected to said throttle plate, an electrically operated fuel injector secured on said support plate including a nozzle thereon having an outlet located in spaced, coaxial relationship to the inlet throat section of said fuel flow orifice, means including a movable pintle for directing a conical spray pattern from said nozzle outlet during a fuel injection, passage means forming a vacuum break in said throttle plate between said nozzle outlet and said fuel flow orifice to isolate said nozzle outlet from the vacuum conditions within the intake manifold, said orifice having its walls contoured to receive the conical spray pattern from said nozzle for unrestricted passage as a spray cone into the inlet end of said throttle body for mixture with air during engine operation at the reduced vacuum mode, said passage means serving to direct idle air from said throttle bore into said fuel flow orifice when said throttle valve is in a closed position to cause sonic flow of idle air through said fuel flow orifice during a high vacuum mode of operation to produce sonic mixing of said conical spray pattern of fuel with idle air.

4. A carburetor assembly for association with an internal combustion engine having an intake manifold operative in low vacuum and high vacuum modes comprising: a throttle body having an air-fuel passage therethrough open at opposite ends thereof, one of said open ends adapted to be connected to the intake manifold of a vehicle, a throttle plate closing the other of said open ends including a pair of throttle bores directed therethrough, a throttle valve in each of said bores, means for rotatably actuating each of said throttle valves for movement between closed and open positions in counterrotation with respect to one another in response to vehicle accelerator operation, said plate including a fuel flow orifice directed therethrough at a point therein equidistantly spaced from the centerline of each of said bores, said orifice including a small diameter inlet throat and a radially outwardly diverging portion in communication with the air-fuel passage through said throttle body, fuel injector means including a nozzle having an outlet therefrom, a movable pintle axially movable with respect to said outlet in said nozzle for producing a conical spray pattern from said outlet, means for supporting said nozzle to locate said outlet therein colinearly of the longitudinal axis of said orifice in spaced relationship therewith, means defining a vacuum break passage between said nozzle outlet and the inlet throat to said orifice to isolate said spray nozzle outlet from vacuum conditions within said throttle body, said orifice having its walls contoured to accommodate the shape of said conical spray pattern from said nozzle to produce unrestricted passage of said conical spray into the air-fuel passage of said throttle body for mixing with air therein under low vacuum modes of engine operation, said vacuum break passage directing idle air from said throttle bores to said orifice when said throttle valves are in their closed position to produce sonic flow of idle air through said orifice under high vacuum operating modes for optimization of mixing air-fuel components directed through said orifice under idle conditions.

5. A carburetor assembly for association with an internal combustion engine having an intake manifold operative in low vacuum and high vacuum modes comprising: a throttle body having an air-fuel passage therethrough open at opposite ends thereof, one of said open ends adapted to be connected to the intake manifold of a vehicle, a throttle plate closing the other of said open ends including a pair of throttle bores directed therethrough, a throttle valve in each of said bores, means for rotatably actuating each of said throttle valves for movement between closed and open positions in counterrotation with respect to one another in response to vehicle accelerator operation, said plate including a fuel flow orifice directed therethrough at a point therein equidistantly spaced from the centerline of each of said bores, said orifice including a small diameter inlet throat and a radially outwardly diverging portion in communication with the air-fuel passage through said throttle body, fuel injector means including a nozzle having an outlet therefrom, a movable pintle axially movable with respect to said outlet in said nozzle for producing a conical spray pattern from said outlet, means for supporting said nozzle to locate said outlet therein colinearly of the longitudinal axis of said orifice in spaced relationship therewith, means defining a vacuum break passage between said nozzle outlet and the inlet throat to said orifice to isolate said spray nozzle outlet from vacuum conditions within said throttle body, said orifice having its walls contoured to accommodate the shape of said conical spray pattern from said nozzle to produce unrestricted passage of said conical spray into the air-fuel passage of said throttle body for mixing with air therein under low vacuum modes of engine operation, said vacuum break passage directing idle air from said throttle bores to said orifice when said throttle valves are in their closed position to produce sonic flow of idle air through said orifice under high vacuum operating modes for optimization of mixing air-fuel components directed through said orifice under idle conditions, said throttle plate further including a groove in the upper surface thereof with one end thereon in communication with said vacuum break passage, lubricant bore means in said plate in communication with the opposite end of said groove for directing lubricant into said vacuum break passageway for flow through said fuel flow orifice during engine operation, said lubricant being thoroughly mixed with air and fuel during the sonic mode of operation to direct lubricant through said throttle body for passage into the intake manifold of an engine during its operation.

* * * * *